US006190821B1

(12) United States Patent
Vandenabeele

(10) Patent No.: US 6,190,821 B1
(45) Date of Patent: Feb. 20, 2001

(54) FILM MATERIALS COMPRISING COLORED MATTING PARTICLES

(75) Inventor: Hubert Vandenabeele, Mortsel (BE)

(73) Assignee: Agfa-Gevaert, N.V., Mortsel (BE)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/974,220

(22) Filed: Nov. 19, 1997

(30) Foreign Application Priority Data

Nov. 21, 1996 (EP) ..... 96203262

(51) Int. Cl.[7] ..... G03C 5/17

(52) U.S. Cl. ..... 430/139; 430/390; 430/559; 430/950

(58) Field of Search ..... 430/950, 139, 430/390, 559

(56) References Cited

U.S. PATENT DOCUMENTS 4,952,484 * 8/1990 Katoh et al. ..... 430/496
5,213,951 * 5/1993 Delfino ..... 430/504
5,468,599 * 11/1995 Biavasco et al. ..... 430/512
5,576,160 * 11/1996 Goan et al. ..... 430/509
6,027,866 * 2/2000 Ohzeki ..... 430/521
6,117,626 * 9/2000 Yamane et al. ..... 430/509

FOREIGN PATENT DOCUMENTS

0468211 * 1/1992 (EP) ..... G03C/1/83
0561475 * 9/1993 (EP) ..... G03C/1/83
0606077 * 7/1994 (EP) ..... G03C/1/005
0655645 * 5/1995 (EP) ..... G03C/1/83

* cited by examiner

*Primary Examiner*—Hoa Van Le
(74) *Attorney, Agent, or Firm*—Breiner & Breiner

(57) ABSTRACT

A photosensitive silver halide film material is disclosed comprising a support and on one or both sides thereof one or more layer(s) comprising a photosensitive silver halide emulsion wherein tabular silver halide crystals having an average thickness of less than 0.25 $\mu$m and an average aspect ratio of 2 or more are present characterized in that said photosensitive silver halide emulsion layer(s) comprise(s) blue colored polymeric matting particles.

9 Claims, No Drawings

FILM MATERIALS COMPRISING COLORED MATTING PARTICLES

DESCRIPTION

1. Field of the Invention

This invention relates to photosensitive film materials and image-forming systems wherein said materials are forming an image by wet or dry processing after exposure to radiation.

2. Background of the Invention

Image forming systems wherein photosensitive silver halide film materials are processed after exposure are well-known. Processing of the said materials can be performed wet or dry, depending on the system used.

In radiology e.g. where classical screen-film systems still remain important, phosphors present in an intensifying screen convert X-ray radiation into visible light. The photons of visible light emitted from said phosphors are then absorbed by an adjacent radiographic film material containing light-sensitive silver halide emulsion crystals, whereafter the latent image becomes wet processed in order to give an image ready-for-examination by radiologists.

For applications, such as mammography and diagnosis of extremities, where radiographic images having high sharpness are required, suitable screen-film systems usually contain only one screen. Light-sensitive silver halide photographic layer(s) coated at only one side of a film support are used in this application, wherein the outermost layer of said film should be in close contact with the said screen in favour of sharpness.

For general applications wherein a higher sensitivity is preferred the screen-film system contains two screens. Between the said screens the film is positioned and comprises on each side of the support at least one light-sensitive silver halide photographic layer.

In the light-sensitive layers tabular silver halide emulsion crystals are frequently used nowadays. Tabular grains are disclosed e.g. in U.S. Pat. No. 4,414,304 for their high covering power (even at high hardening levels of the binder material, thus permitting the coating of lower amounts of silver halide) and developability, and in U.S. Pat. Nos. 4,425,425 and 4,425,426 for their lower cross-over. All these effects are the result of a higher surface to volume ratio characteristic for said tabular grains.

An unacceptable disadvantage of tabular grains is the brownish color of the developed silver after processing, especially when said grains have a thickness of less than 0.30 $\mu$m. For thinner tabular grains even a more tremendous deterioration from the desired black image tone is observed, especially when the image is examined in transparency (as radiologists perform their examinations), but also under reflected light conditions.

Another problem encountered when use is made of tabular grains having a higher surface to volume ratio is residual dye stain: although adsorption of higher amounts of spectrally sensitizing dyes offers the advantage of absorption of more incident light and of reduced cross-over, dye stain occurs after processing, due to incomplete removal of said dye(s) from the processed material.

A solution for these problems has been described in e.g. EP-A 0 468 211 and in EP-A 0 655 645. Therein a blue colored pigment is added to the photographic sensitive layer or another layer of the film in order to reduce residual dye stain but simultaneously to provide a black image tone. The blue pigment used in these EP-A's is characterized by an absorption maximum of from 570 to 630 nm and from 640 to 700 nm respectively. In the examples this pigment is added to the light-sensitive emulsion layer containing silver halide emulsion crystals and reduces dye stain after processing by deaggregation of the adsorbed spectral sensitiser, adsorbed at the crystal surface.

In U.S. Pat. No. 4,818,675 a dispersion of a dye having a maximum absorption wavelength of 520 to 580 nm is added to at least one layer on at least one side of a photographic material, such that the transmission density of green light is 0.03 or less after developing treatment of that material. This method leads to improvements surpassing other methods known before in order to improve image tone of developed tabular grains. As tone-regulating agents mercapto compounds are used. In the same document a review is given about methods of introducing dyes (and other additives) in emulsion and/or other layers of a silver halide photographic material: in the form of gelatinous dye dispersions, as an oilformer dispersion, as a polymer latex composition, in the form of a mordant together with a hydrophilic polymer having a charge opposite to that of the charged dye molecule, in dissolved form by using a suitable surfactant (an oligomer or a polymer), in a dispersion with a hydrophilic polymer together with or instead of an oilformer and in micro-capsule form employing therein a polymer having a carboxyl group, a sulphonic group etc.

A problem arising due to the presence of a blue pigment (besides image tone and dye stain) in a photographic element in operative association with an intensifying screen is the risk of staining of the surface of said screen so that artifacts can occur on the image formed after contact made with such stained screen. This phenomenon especially occurs after cleaning the screen surface with solvents used as screen-cleaners. Further blue pigment escaping from the film material often makes dirty the rollers in the automatic processing machine wherein the exposed film material is processed, thereby disturbing images generated on the following films processed therein.

3. OBJECTS OF THE INVENTION

Therefore it is a first object of the present invention to obtain, with classical silver halide photographic film materials, in particular those materials wherein use is made of thin tabular silver halide grains, images with a cold "blue-black" image tone by means of image-tone correcting blue dyes.

It is another object of the present invention to prevent in classical film-screen systems wherein the film comprises a blue dye that the intensifying screens in contact therewith become stained.

It is a further object of this invention to prevent staining of the rollers in automatic processing machines during wet processing of exposed film materials comprising blue dyes.

Other objects of this invention will become apparent from the description hereinafter.

4. SUMMARY OF THE INVENTION

The above objects are accomplished by a photosensitive silver halide film material comprising a support and on one or both sides thereof one or more layer(s) comprising a photosensitive silver halide emulsion, particularly a photosensitive silver halide emulsion having tabular silver halide crystals with an average thickness of less than 0.25 $\mu$m and an average aspect ratio of 2 or more; characterized in that said photosensitive layer(s) comprise(s) blue colored polymeric matting particles.

In particular said light-sensitive film material which is run in wet processing after exposure is used in an image-forming film-screen system for medical diagnostic imaging wherein said film material is used in operative association with one or two intensifying screens comprising on a support a layer of a visible light emitting luminescent phosphor, the said film material comprising a support and on one or both sides thereof a light-sensitive silver halide emulsion layer having spectrally sensitized tabular silver halide and a non-light-sensitive protective layer, characterised in that said light-sensitive silver halide emulsion layer(s) comprise(s) blue colored polymeric matting particles.

5. DETAILED DESCRIPTION OF THE INVENTION

The best results to improve the color of silver generated from developed thin tabular silver halide grains having an average thickness of less than 0.25 $\mu$m and an average aspect ratio of 2 or more, wherein said tabular grains are present in one or more photosensitive layer(s) of an exposed silver halide photographic material, and more particular in a radiographic film material or in an image recording film for medical diagnostic purposes, without increasing the minimum density of the said material, are obtained, when the blue dye is present in blue coloured (pigmented) polymeric matting paticles in one or more light-sensitive emulsion layer(s) comprising said grains.

It is very remarkable and it could even not be expected that no improvement or an insufficient improvement in image tone is observed when the said blue colored polymeric matting particles are present in another hydrophilic layer as e.g. in a protective antistress layer whereupon in some applications an afterlayer is coated: it has been established that the brownish image tone characteristic for developed thin tabular emulsion grains remains about unchanged.

Besides the advantage with respect to image tone, no dye staining of intensifying screens after contact during exposure and no staining of the rollers in automatic processing machines during processing is observed in radiographic screen-film applications. This is illustrative for the fact that the dyes are not diffusing out of polymeric matting particles. Indeed wandering of the blue dyes to layers farther from the support and even out of the material would lead to problems opposite to the objects of this invention set forth hereinbefore. Therefore principally any dye that can be anchored in an emulsion layer, and especially those dyes anchored to developed silver obtained after processing are useful. Principally those anchored dyes of the type A-B or A-L-B wherein A represents a silver binding group, wherein B represents any dye and wherein L represents a divalent linking group are useful if their absorption maximum is situated in the wavelength range between 500 and 800 nm.

In the context of the present invention wherein blue coloured polymeric matting particles are added in dispersed form to one or more emulsion layer(s) of image-forming materials it remains important that the minimum density is lowered without impairing the desired cold blue-black image tone: addition of lower amounts of blue pigment to the blue colored support makes base-density decrease and as a function of amounts of blue pigmented polymer matting particles added in dispersed form to one or more emulsion layer(s) of the said material the total minimum density is set at the desired level in order to get a "fresh look" when examining practical images. Preferred minimum density values as desired by radiologists are therefore accurately prescribed in specifications and are changing from one country to another: an average density not exceeding a value of 0.25 after a guarantee period for the film material of 2 to 3 years is highly preferred. Accordingly in the materials according to this invention the support is colored by means of a blue dye, wherein said blue dye is present in such an amount that the minimum density after processing is not more than 0.25.

Preferred blue colored dyes present in dispersed colored polymeric matting particles are those having the most suitable absorption spectrum, in the visible range of the wavelength spectrum from 570 to 700 nm, more preferred in the range from 570 to 630 nm. Especially those dyes selected from the group consisting of phthalocyanine dyes and indanthron dyes are preferred. It is further clear that a mixture of blue colored pigments can be used, the proviso that at least one of these pigments has a maximum absorption in the visible range of the wavelength spectrum from 570 to 700 nm, and more preferred in the range from 570 to 630 nm.

Preferably the blue pigment(s) present in the support of materials according to the present invention have an absorption spectrum that matches the absorption spectrum of the blue dye(s) or pigment(s) present in dispersed blue colored polymeric matting particles. In a preferred embodiment blue dyes present in the pigmented support and in the emulsion layer(s) coated thereupon as a dispersion of blue colored polymeric matting particles are the same.

According to this invention said blue pigment(s) or dye(s) present in dispersed polymeric matting particles are coated in one or more light-sensitive emulsion layer(s) in an amount of from 10 mg/m$^2$ to 1000 mg/m$^2$, and more preferably in an amount of from 10 mg/m$^2$ up to 500 mg/m$^2$.

Said blue pigments present as blue colored or blue pigmented polymeric matting particles are preferably present as blue colored polymethylmethacrylate polymeric matting particles and are preferably prepared starting from colorless polymeric matting particles which are themselves prepared according to the methods described e.g. in U.S. Pat. Nos. 3,754,924; 4,022,622; 4,820,615 and in EP-A 0 726 490, wherein polymerization methods performed by e.g. pearl polymerization and/or solvent polymerization have been described. In U.S. Pat. No. 4,952,484 the preparation of a colored polymer matting agent by incorporating or adsorbing dyes in the inside or on the surface of fine particles of a polymer has been given. In the said patent specification said colored polymer matting agents are coated in the uppermost layer at the emulsion side or at the back side of the support opposite the layer having the silver halide emulsion in order to inhibit the occurrence of black spots in the field of graphic arts materials or more in general in high contrast image-forming systems.

Preferred mean particle sizes of the dispersed blue colored polymeric matting particles for use in the materials according to the present invention are preferably from 1 $\mu$m to 10 $\mu$m, more preferably from 1 $\mu$m up to 6 $\mu$m and even more preferably from 1 $\mu$m up to 3 $\mu$m, although smaller particle sizes as e.g. 0.2 $\mu$m are not excluded.

By making use of said selected blue pigment(s) in form of a dispersion of blue colored polymeric matting particles in the prescribed amounts in one or more photosensitive silver halide emulsion layer(s) a solution is offered for the problems situated hereinbefore: a suitable blue-black cold image tone is obtained for the processed silver halide tabular grains, particularly when the image is examined in transparency (as radiologists perform their examinations in the medical diagnostic applications) whereas under reflected light conditions the effect is not always convincing.

In addition, in the application wherein use is made of radiographic screen-film systems, there is no staining of the intensifying phosphor screens after making frequent contact with films comprising said blue colored pigments, even not after a cleaning procedure wherein organic solvents are used as e.g. isopropanol. Moreover no staining is further observed on the rollers of automatic processing machines wherein said films are run after exposure.

According to the present invention light-sensitive spectrally sensitized tabular silver halide grains are used in at least one emulsion layer, wherein said tabular grains have an aspect ratio of from 2 to 20, a thickness from 0.06 to less than 0.25 $\mu$m, more preferably from 0.06 to 0.20 $\mu$m and wherein said grains account for at least 50%, more preferably for at least 70% and even more preferably for at least 90% of the total projective area of all grains. In a more preferred embodiment aspect ratios of said tabular grains are from 5 to 20 and still more preferred aspect ratios are from 8 to 20. As more homogenous silver halide crystal distributions are preferred, preferred variation coefficients are less than 0.30, more preferred less than 0.20 and still even more preferred from 0.10 to 0.15. Such low variation coefficient can be attained by application of preparation methods for such tabular grains as has been described e.g. in U.S. Pat. Nos. 5,147,772; 5,147,773; 5,171,659; 5,210,013 and 5,215,879.

Silver halide compositions of said tabular grains are silver bromide, silver bromochloride, silver bromochloroiodide, silver bromoiodide, silver chloride, silver chlorobromide, silver chloroiodide or silver chlorobromoiodide, wherein firstly named halides are present in higher amounts than halides named later. Halide ions may be divided homogeneously or heterogeneously over the grain volume, depending on the preparation method used. Preparation methods for tabular grain emulsions have been described e.g. in EP-A 0 569 075 (in a gelatinous dispersing medium), in EP-A 0 677 773 (in colloidal silica) and in Research Disclosures 22534, January 1983; 232012, August 1983 and 36544, September 1994, i.a. in part I (Emulsion grains and their preparation). Coated amounts of silver in the silver halide emulsion layer(s) of the film material according to this invention are in the range from 1 to 6 g/m$^2$, and more preferably, from 3 to 5 g/m$^2$ and per side, expressed as an equivalent amount of silver nitrate.

For photosensitive silver halide materials run in wet processing, wherein said materials, according to this invention, comprise on one or both sides of a support one or more light-sensitive silver halide emulsion layer(s), the following addenda may be used.

Vehicles, vehicle extenders, vehicle-like addenda and vehicle related addenda which may be used can be found in Research Disclosure 36544, part II. Washing procedures for said emulsions can be applied as described in part III of the said RD. Emulsions used in the film material used in the image-forming system according to this invention may be chemically sensitized as has been described in RD 36544, chapter IV.

According to the present invention said light-sensitive tabular silver halide grains are spectrally sensitized to the blue, to the green, to the red and even to the infrared region of the wavelength spectrum. In screen-film systems wherein the screens comprise blue or green light emitting phosphors blue sensitized or green sensitized emulsion crystals are used. In recording materials as e.g. laser recording materials or photothermographic materials red sensitizers and even infrared sensitizers may be used in order to spectrally sensitize tabular emulsion crystals. Spectral sensitizers used therefore have been described in Research Disclosure 22534, January 1983, in RD 36544, chapter V, in EP-A's 0 757 285, 0 752 617, 0 712 034, 0 712 036, in EP-A's 0 105 425, 0 144 091, 0 300 382, 0 487 010, 0 677 773 and 0 678 772 and in U.S. Pat. Nos. 4,942,121 and 5,108,887.

Development acceleration in order to enhance speed in the same processing cycle or in order to maintain speed in a shorter developing time can be accomplished by incorporating in the emulsion layer or adjacent layers various compounds, preferably polyoxyalkylene derivatives having a molecular weight of at least 400 such as those described in e.g. U.S. Pat. Nos. 3,038,805; 4,038,075 and 4,292,400 or development accelerators described in EP-A's 0 634 688 and 0 674 215.

The protective antistress layer and, if present, an afterlayer, may contain a polymeric compound in an amount of at least 0.2 g per m$^2$ and more preferably at least 0.4 g/m$^2$. Said protective antistress layer may be composed of two different layers, wherein the layer more close to the support may act as an intermediate layer. Said two different layers may have the same composition, except for e.g. the presence of one or more additional blue dye(s) in dispersed form as described in EP-Application No. 96200417, filed Feb. 19, 1996. In order to provide a film material applicable in rapid processing applications it is further important to have said polymeric compound in the protective antistress layer in an amount of not more than 2 g/m$^2$, especially with regard to drying velocity.

The said polymeric compound can be a compound selected from the group consisting of gelatin, a synthetic, semi-synthetic or natural substitute for gelatin, and latex (co)polymers. The presence of (additional) amounts of (natural or synthetic) clay and/or colloidal silica is further highly appreciated in favour of physical surface characteristics as such as glare, slidability, etc.

Gelatin is well-known as an essential polymeric compound of hydrophilic colloid layers in photographic materials. Synthetic substitutes for gelatin are e.g. polyvinyl alcohol, poly-N-vinyl pyrrolidone, polyvinyl imidazole, polyvinyl pyrazole, polyacrylamide, polyacrylic acid, and derivatives thereof, in particular copolymers thereof. Natural substitutes for gelatin are e.g. other proteins such as zein, albumin and casein, cellulose, saccharides, starch, and alginates. In general, the semi-synthetic substitutes for gelatin are modified natural products e.g. gelatin derivatives obtained by conversion of gelatin with alkylating or acylating agents or by grafting of polymerizable monomers on gelatin, and cellulose derivatives such as hydroxyalkyl cellulose, carboxymethyl cellulose, phthaloyl cellulose, and cellulose sulphates.

Gelatin can be lime-treated or acid-treated gelatin. The preparation of such gelatin types has been described in e.g. "The Science and Technology of Gelatin", edited by A. G. Ward and A. Courts, Academic Press 1977, page 295 and next pages. The gelatin can also be an enzyme-treated gelatin as described in Bull. Soc. Sci. Phot. Japan, No. 16, page 30 (1966).

Examples of latex (co)polymers used in the film material according to this invention have been described in e.g. Research Disclosure 19551, July 1980, and further in EP-A's 0 452 568; 0 534 006; 0 558 196 and 0 643 326; in U.S. Pat. Nos. 3,443,946; 3,589,908; 3,640,721; 4,476,218 and 4,810,624 and in JP-A 06250315. Especially preferred latex polymers are e.g. latex containing polyacrylic acid as described in JP-A 05134336 and in EP-A 0 644 456. Clays used in layers of photographic material are disclosed e.g. in EP-A 0 644 454, wherein i.a. particular synthetic clays have been described, which are very suitable to reach good surface characteristics when used in outermost layers.

In a preferred embodiment colloidal silica as disclosed in e.g. EP-A 0 670 517 is added to the coating solution(s) of the protective antistress layer and/or to an afterlayer, if present.

In another embodiment gelatin-grafted polymer particles as disclosed e.g. in U.S. Pat. Nos. 5,393,650 and 5,426,020 or matte polymeric particles covalently bound to gelatin and colloidal silica as disclosed in U.S. Pat. No. 5,300,411 are added to the coating solution(s) of the protective antistress layer and/or to an afterlayer, if present. Said polymeric matting particles may be covered by a layer of colloidal inorganic particles as described in e.g. in U.S. Pat. Nos. 5,288,598 and 5,378,577. Organic polymer particles as described in e.g. U.S. Pat. Nos. 4,914,012 and 5,342,733 may also be added as well as matting agents described in e.g. JP-A 04162032. Lubricants may further be added as described e.g. in U.S. Pat. No. 4,766,059 and in JP-A 05107687.

Other useful ingredients which may be present in the material are described hereinafter.

UV absorbing dyes, optical brighteners and luminescent dyes can be used as described in RD 36544, chapter VI. Antifoggants and stabilizers can be used as described in the same RD, chapter VII. In Chapter VII of the said RD i.a. useful absorbing dyes, used as antihalation dyes are summarized. Further useful filter dyes have been described e.g. in EP-A's 0 656 401 and 0 724 191 and EP-Application No. 93001438, filed Dec. 22, 1993.

Coating physical property modifying addenda like coating aids, plasticizers, lubricants, antistats and matting agents useful in the preparation of the coating solutions of the light-sensitive and non-light sensitive film layers are further described in RD 36544, chapter IX.

The gelatin binder of the radiographic film materials used in the system according to the present invention can be hardened with appropriate hardening agents such as those of the epoxide type, those of the ethylenimine type, those of the vinylsulfone type e.g. 1,3-vinylsulphonyl-2-propanol or di-(vinylsulphonyl)-methane, ethylene di-(vinyl-sulphone), vinylsulphonyl-ether compounds and vinylsulphonyl compounds having soluble groups, aldehydes like e.g. formaldehyde, glyoxal, and glutaric aldehyde, N-methylol compounds e.g. dimethylolurea and methyloldimethylhydantoin, dioxan derivatives e.g. 2,3-dihydroxy-dioxan, active vinyl compounds e.g. 1,3,5-triacryloyl-hexahydro-s-triazine, active halogen compounds e.g. 2,4-dichloro-6-hydroxy-s-triazine, and mucohalogenic acids e.g. mucochloric acid and mucophenoxychloric acid. These hardeners can be used alone or in combination. The binder can also be hardened with fast-reacting hardeners such as carbamoylpyridinium salts as disclosed in U.S. Pat. No. 4,063,952 and with the onium compounds as disclosed in EP-A 0 408 143. In order to get sufficiently hardened the binder should dispose of an acceptably high number of functional groups, which by reaction with an appropriate hardening agent can provide a sufficiently resistant layer. Such functional groups are especially amino groups, but also carboxylic groups, hydroxy groups, and active methylene groups.

In order to get a film material applicable in rapid wet processing applications it is necessary to have a film material that has been hardened to such an extent that a water absorption per gram of gelatin is not more than 3 g per gram of gelatin and even more preferred a water absorption of not more than 2 g per gram of gelatin. Said amount of water absorption is determined after incubating a sample of said film material at 57° C. and 34% RH for 3 days, weighing said sample, immersing it in distilled water at 21° C. for 3 minutes, squeezing it in order to get a surface free from water drops and weighing it again. Calculation of the differences in weight, divided by the surface area of the film strip and by the amount of gelatin coated per square meter gives the required value.

Another more suitable way to express the requirement to sufficiently harden the binder in the film material used in the screen-film system of this invention is to express it as a procentual swelling degree: the said procentual swelling degree, should not exceed a value of 300%, and more preferably should not exceed a value of 200%. Therefore after incubating a sample of a material at 57° C. and 34% RH for 3 days the thickness (a) of the layer assemblage is measured. Thereafter the sample is immersed in distilled water at 21° C. for 3 minutes and the thickness (b) of the swollen layer is measured. The swelling ratio is then calculated as:

$$(b-a)/a\times 100(\%).$$

Layers and layer arrangements which can be applied to the film material according to this invention are those described in EP-A's 0 752 617, 0 712 036, 0 712 034, 0 677 773 and 0 678 772, in EP-A's 0 610 608; 0 610 609 and in EP-A 0 569 075, in U.S. Pat. Nos. 4,092,168 and 4,311,787; in DE 2,453,217 and in GB Patent 7,907,440.

Supports and subbing layers coated adjacent thereto, useful for the film materials according to this invention, can be those as described in RD 36544, chapter XV, polyethylene naphthalate inclusive. For high speed processing applications a useful subbing layer is disclosed e.g. in JP-A 01166031. Vinylidene chloride and styrenebutadiene copolymers are the most well-known polymers for practical use as subbing layer ingredient in the film material of the screen-film system of this invention. In order to get a suitable image tone for the developed silver most of the said supports are already blue-coloured by incorporating blue dyes, preferably by incorporating the same blue dyes as in the emulsion layer(s) of materials used in the present invention. Antistatic agents can be provided therein as described e.g. in U.S. Pat. No. 5,391,472 and in EP-A's 0 534 006, 0 644 454 and 0 644 456.

According to the present invention radiographic materials are present in an image-forming system wherein said material is a film for medical diagnostic imaging used in operative association with one or two intensifying screens comprising on a support thereof a layer of a light emitting luminescent phosphor. Light emitting should be understood herein as ultraviolet, blue or green light emitting. According to the present invention a preferred screen in the screen-film system according to this invention is an intensifying screen comprising a green light-emitting luminescent phosphor, and more preferred a $Gd_2O_2S$:Tb luminescent phosphor or a M or M' Y(Sr,Li)$TaO_4$ blue emitting phosphor, whether or not mixed together with barium fluorobromide phosphors, doped with europium.

In the system according to this invention a screen or a combination of screens can be used as has been described e.g. in EP-A's 0 592 724, 0 510 754, 0 647 258 and 0 648 254.

For double side coated film materials it is clear that any combination of a symmetrical or asymmetrical film arrangement together with a symmetrical or asymmetrical pair of screens is useful. Herein the term "symmetrical or asymmetrical film arrangement" refers to film materials wherein sensitivity, gradation and/or spectral sensitivity is equal or not at opposite sides of the film support. Further the term "symmetrical or asymmetrical pair of screens" refers to screens wherein speed and/or spectral sensitivity is equal or is differing for both screens.

The photographic material containing chemically and spectrally sensitized tabular grains used in the system according to the present invention is image-wise exposed to visible light, preferably green light, generated from converted X-rays emitted by an X-ray source emitting X-rays with an energy adapted to the specific application. Conversion of X-rays proceeds by the preferred green light-emitting phosphors making part of the screens of the image-forming film-screen system according to this invention.

It is clear that in a preferred embodiment this invention is applied in an image-forming system wherein silver halide materials are used for medical diagnostic imaging in operative association with one or two intensifying screens comprising on a support thereof a layer of a light emitting luminescent phosphor, application of this invention is not restricted to medical X-ray films, used in screen-film applications. For every film coated on one or both sides of its support with one or more layers having thin tabular silver halide grains, optionally comprising fine cubic and/or octahedral grains, and showing, after wet processing, the occurrence of brownish images, a solution is found by addition of blue colored polymer matting particles in emulsion layers containing the said thin tabular grains.

As an example single-side coated films having thin tabular grains for laser applications are mentioned, wherein said tabular grains are spectrally sensitized with dyes having a maximum absorption in the wavelength region of the correspondingly used laser exposure source, even exceeding the wavelength region of the visible spectrum as by infrared radiation. Said films are used in graphical and in medical diagnostic image-forming applications.

Of course processing conditions and composition of processing solutions after image-wise exposure of the film material according to this invention are dependent from the specific type of photographic material in which the spectrally sensitized tabular grains are present (optionally together with fine cubic and/or octahedral grains having an average diameter of from 0.05 up to 0.30 $\mu$m). For example, in a preferred embodiment of materials for X-ray diagnostic purposes said materials are adapted to rapid processing conditions. Preferably an automatically operating processing apparatus is used provided with a system for automatic regeneration of the processing solutions. Forehardened materials may be processed using one-part package chemistry or three-part package chemistry. Applications within total processing times of 30 seconds and even shorter up to processing times of 90 to 120 seconds, known as common praxis, are possible. From an ecological point of view it is e.g. possible to use sodium thiosulphate instead of ammonium thiosulphate in the fixer solution. Useful processing compositions in the processing of films used in the system according to this invention have been described in EP-A 0 542 354, which is incorporated herein by reference.

Besides in "classical photographic systems" also in photothermographic systems a suitable image tone is preferred. Techniques as set forth e.g. in U.S. Pat. No. 5,422,234 wherein small amounts of a blue colorant are added to an overcoat layer and/or an adhesive interlayer are especially useful therein. Examples of photothermographic materials are the so called "Dry Silver" photographic materials of the 3M Company, which are reviewed by D. A. Morgan in "Handbook of Imaging Science", edited by A. R. Diamond, page 43, published by Marcel Dekker in 1991. Tabular grains mentioned hereinbefore in "classical" silver halide photographic systems are also used in photothermographic silver halide materials as has been set forth in U.S. Pat. No. 4,435,499 and indeed give the same problem of brownish image-tone. As in photothermographic systems use is frequently made of small cubic silver bromide or silver bromoiodide grains having a crystal diameter of from 0.05 $\mu$m up to less than 0.1 $\mu$m an unsatisfactory image-tone is often met. For photothermographic materials having such small cubic silver halide grains in an emulsion layer, blue colored polymeric matting agents may be used in favour of a suitable black image tone in the said layer. Otherwise for a transparent photothermographic recording material having a support bearing a photo-addressable thermosensitive element comprising photosensitive silver halide grains, a reducing agent for silver ions and a binder, wherein silver halide grains are tabular silver halide grains having silver halide, and more preferably silver chloride, in an amount of 50 mole % or more, more preferably in an amount of 70 mole % or more, and an average grain thickness of 0.20 $\mu$m or less and wherein said tabular grains account for at least 50% of the total projective surface area of all silver halide grains, an emulsion layer wherein said silver halide grains are present preferably comprise(s) blue colored polymeric matting particles, according to the present invention.

Said photo-addressable thermally developable materials, apart from blue colored polymeric matting particles in favour of image tone after heat-processing, comprise a substantially light-insensitive organic silver salt, photosensitive silver halide in catalytic association therewith and an organic reducing agent in thermal working relationship with the substantially light-insensitive organic silver salt and a binder. The element may comprise a layer system with the silver halide in catalytic association with the substantially light-insensitive organic silver salt ingredients, spectral sensitizer optionally together with a supersensitizer in intimate sensitizing association with the silver halide particles and the other ingredients active in the thermal development process or pre- or post-development stabilization of the element being in the same layer or in other layers with the proviso that the organic reducing agent and the toning agent, if present, are in thermal working relationship with the substantially light-insensitive organic silver salt i.e. during the thermal development process the reducing agent and the toning agent, if present, are able to diffuse to the substantially light-insensitive organic silver salt. A detailed description of all ingredients used is given in e.g. EP-Application No. 96203269, filed Nov. 21, 1996. Spectral sensitization in order to absorb infrared radiation not always requires a supersensitizer as has been illustrated in EP-Application No. 96202100, filed Jul. 24, 1996. A production method for a photothermographic recording material and a recording process therefor may be applied as disclosed in EP-Application No. 96200648, filed Mar. 9, 1996, when blue colored polymer matting particles are included in the photosensitive layer of the said material according to the present invention. In order to conventionally obtain a neutral black image tone in the higher densities and neutral grey in the lower densities of photo-addressable thermally developable element, preferably in admixture with organic heavy metal salts and reducing agents, a so-called toning agent known from thermography or photothermography is used. Suitable toning agents are succinimide and the phthalimides and phthalazinones within the scope of the general formulae described in U.S. Pat. No. 4,082,901. Further reference is made to the toning agents described in U.S. Pat. Nos. 3,074,809, 3,446, 648 and 3,844,797. Other particularly useful toning agents are the heterocyclic toner compounds of the naphthoxazine dione or benzoxazine dione type and toners described in GB-P 1,439,478 and U.S. Pat. No. 3,951,660. A toner compound particularly suited for use in combination with polyhydroxy benzene reducing agents is 3,4-dihydro-2,4-dioxo-1,3,2H-benzoxazine described in U.S. Pat. No. 3,951, 660. Further addition to the support of blue dyes is in favour of colour correction of image tone in the direction of a cold "blue-black" fresh look.

The following examples illustrate the invention without however limiting it thereto.

EXAMPLES

1. Blue Colored Dye Used in the Example

| DYE | MARKETED BY | TRADE NAME |
|---|---|---|
| A | Bayer | MACROLEXBLAU RR |

2.Preparation of Dispersion of the Blue Colored Polymeric Matting Particles

A mean particle size for the blue pigmented polymeric matting particles of 3 μm was obtained after loading cross-linked polymeric particles in the following way. From MACROLEXBLAU RR (dye A) 1 g was dissolved in 20 ml of ethyl acetate. The solution was dispersed in 5 minutes in 50 ml of demineralized water, stirring at 12000 rpm. 5 ml of a 10% aqueous solution of the sodium salt of n-dodecyl-benzene sulphonic acid was added as a surface active agent. The dispersion of the dye obtained as described hereinbefore was added to 45 g of a 16.5 wt % aqueous dispersion of polymer matting particles having a polymethylmethacrylate composition and an average particle size of 3 μm. After stirring for 1 hour ethyl acetate was removed by evaporation under reduced pressure. The homodisperse polymeric methylmethacrylate matting particles were loaded with the blue dye A and were free from conglomerates.

The matting particles loaded with the blue dye were dispersed in a gelatinous solution (10 wt %) in order to obtain a dispersion of 10 wt % of blue dye A colored matting particles. The blue dye content of the matting agent was 8% by weight.

3. Preparation Method of Double-Side Coated X-ray Materials 3.1. Supports 1 and 2

A blue dyed polyethylene terephthalate film support of 175 μm thickness was used. Support 1 had a specular density of 0.183 for white light; support 2, containing a smaller amount of blue dye had a specular density of 0.147 for white light. Said specular density for white light was measured with a Mc Beth densitometer with diffuse geometry as described in ISO 5-2 and spectral response as described in ISO 5-3.

3.2. Subbing Layer

At both sides of the film support a subbing layer was coated. This subbing procedure resulted in the following layer composition per $m^2$ and per side of said film support:

- 0.170 g of a latex copolymer of vinylidene chloride (88% by weight), methylacrylate (10% by weight) and itaconic acid (2% by weight),
- 0.06 g of a latex copolymer of methyl methacrylate (47.5% by weight), 1,3-butadiene (47.5% by weight) and itaconic acid (2% by weight),
- 0.001 g of poly methyl methacrylate-particles with an average diameter of 3.5 μm used as a matting agent,
- 0.003 g of Akypo OP 80 (trademarked product from Chemy) and 0.001 g of Hostapal BV (trademarked product from Hoechst AG) as coating aids.

3.3. Preparation of the Coating Solution of the Light-Sensitive Emulsion Layer 3.3.1. Preparation of AgBr(I) Tabular Grains A tabular silver bromoiodide emulsion, containing 1 mole % of AgI and 99 mole % of AgBr, was precipitated using the double jet technique. The excessive amount of soluble $KNO_3$ salt generated during precipitation of AgBr(I) crystals was removed by washing after emulsion flocculation following said precipitation.

The crystals of the thus obtained tabular grain emulsion, containing 75 grams of gelatin per mole of $AgNO_3$, had the following characteristics, determined according to the method described in U.S. Pat. No. 4,414,304:

- mean diameter of a circle with the same projective surface of the tabular grain: 1.12+/−0.23 μm (0.23 being the standard deviation s).
- mean thickness of the tabular grains: 0.23 μm.
- aspect-ratio: 5.5.
- procentual part of the total projective surface of all grains present, covered by the tabular grains: 98%.

3.3.2. Chemical Sensitization

This emulsion was chemically sensitized in the presence of anhydro-5,5'-dichloro-3,3'-bis(n.sulfobutyl)-9-ethyloxacarbocyanine hydroxide, chloro auric acid, sodium thiosulphate and potassium thiocyanate.

3.3.3. Preparation of the Coating Solution of the Light-Sensitive Silver Halide Emulsion Layer Per mole of $AgNO_3$ were added to the above described emulsion at 40° C.: 0.29 g of 4-hydroxy-6-methyl-1,3,3a,7-tetra-azaindene; 9.1 g of sorbitol; 14.5 g of poly ethyl acrylate (MW=1000000); 3.05 g of 1,3-dihydroxybenzene; 31 g of dextrane (MW=10000); gelatin and demineralised water in an amount necessary to get an appropriate wet coating thickness and gelatin content per $m^2$.

3.4. Preparation of the Coating Solution of the Protective Layer

To 800 ml of demineralized water were added: 44 g of a solution (30% by weight) of KIESELSOL 300F (trademarketed by BAYER AG), 0.92 g of polymethyl-methacrylate (average particle diameter: 3.5 μm); 0.3 g of ammoniumperfluorocaprylate and 10.8 g of a solution (37% by weight) of formaldehyde. Gelatin and demineralized water was added to obtain the appropriate wet coating thickness and the desired amount of gelatin per $m^2$.

3.5. Coating Method of the Photographic Materials

The materials were obtained by coating at 38° C., on the support provided with a subbing layer at both sides, the above described coating solutions for the emulsion layer and the protective antistress layer respectively. Said materials were dried under controlled conditions of humidity and temperature, said temperature never exceeding 30° C.

The emulsion layer and protective antistress layer were coated simultaneously by the slide hopper coating technique with the emulsion layer in direct contact with the subbing layer. Before drying the thickness (known as "wet thickness") of the emulsion layer was 44 μm. Per $m^2$ and per side of the support the emulsion layer contained an amount of 3.8 g of AgBr(I), said amount being expressed as an equivalent amount of silver nitrate, and of 1.9 g of gelatin.

4. Evaluation Procedures 4.1. Determination of Photographic Sensitivity

Samples of the photographic materials were exposed using a continuous wedge with green light of 540 nm during 0.1 seconds and were processed in a 45 seconds cycle of a CURIX HT530 (Agfa-Gevaert trademarked name) processor.

Commercially available G138 developer and G334 fixer, both trademarked names from Agfa-Gevaert, were used as processing chemicals.

The density as a function of the light dose (log E) was then measured and the log E value at a density of 1.00 above fog was determined. This value was representing the sensitivity of the material. A more sensitive material has a lower log E value (requires a lower light dose).

4.2. Determination of Fog

Unexposed samples were processed in the above described processing cycle. The specular density for white light was then determined. This fog thus includes the density of the blue dyes in the undercoat layer (support) and in the layers coated thereupon.

4.3. Determination of Dye Stain at the Surface of the X-ray Screen

The X-ray screen (format 24 cm×30 cm) was made slightly wet with Agfa-Gevaert Curix "screen-cleaner". This screen-cleaner mainly consists of isopropanol.

On the wetted X-ray screen, samples of the undeveloped photographic materials were placed. Thereupon a cardboard and a weight of 10 kg was placed during 2 hours.

The samples were then removed and the color of the X-ray screen was examined for dye stain. When dye stain was present, this X-ray screen was treated to be cleaned with the Curix "screen-cleaner". When the dye stain disappeared, the dye stain was called "cleanable".

The X-ray screen used in this dye stain test was CURIX ORTHO REGULAR 1FFJ5P (trademarketed screen by Agfa-Gevaert NV).

Example

This Example shows the importance of the location and the amount of the blue colored dyes in the material. Therefore materials Nos. 1 to 6 were coated as follows:

Material No. 1 (Comparative Example)

Material No. 1 was obtained by coating support 1 as described above with the coating solution of the protective layer, coated at a wet thickness of 25 $\mu$m and at a gelatin content per $m^2$ and per side of the support of 1.1 g.

Material No. 2 (Inventive Example)

Material No. 2 was coated just as Material No. 1, except for the use of support 2 instead of support 1 and dispersion of the blue colored polymeric matting agent was added to the coating solution of the silver halide emulsion layer in an amount corresponding with 120 mg of matting agent per $m^2$ and per side after coating.

Material No. 3 (Inventive Example)

Material No. 3 was coated just as Material No. 2, except for the presence of an amount of blue colored polymeric matting agent of 73 mg/$m^2$ and per side.

Material No. 4 (Comparative Example)

Material No. 4 was coated just as Material No. 1, except for the use of support 2 instead of support 1 and the addition of the dispersion of the blue colored polymeric matting agent to the solution of the protective layer in an amount corresponding with 73 mg/$m^2$ and per side of matting agent after coating.

Material No. 5 (Comparative Example)

Material No. 5 was coated just as Material No. 1, except for the use of support 2 instead of support 1 and addition of the milled dye dispersion of blue colored dye (thus without the presence of polymeric matting particles) to the coating solution of the silver halide emulsion layer in an amount of 10.5 mg/$m^2$ and per side of the blue dye after coating. Said milled dye dispersion of blue colored dye A was prepared by dispersing 20 g of powder of the blue dye A at 45° C. in 200 g of an aqueous gelatinous solution (8% by weight) in a rotating pearl mill (Dynomill KD15) containing as a milling material zirconium oxyde pearls having a size of 1.0 to 1.6 $\mu$m and 4 grams of Mersolat H76 Paste (trademarked product from Bayer AG, Leverkusen, Germany) were used as a dispering agent. The milling procedure was stopped when a mean particle size of 0.6 $\mu$m was obtained.

Material No. 6 (Comparative Example)

Material No. 6 was coated just as Material No. 5, except for the presence of the dispersion of the blue dye in the coating solution of the protectiver layer.

In Table I for the materials Nos. 1 to 6, Nos. 2 and 3 being coated according to this invention, data are summarized about support density, layer in which the dye has been coated in blue colored polymeric matting form (BCPM) or milled blue dye dispersion (MBDD), amount of blue colored polymeric matting agent (if present in BCPM form) and effective amount of blue dye present per $m^2$ and per side of the coated material.

TABLE I

| MATL No. | Support density | Dye present in | Dye present as | mg/$m^2$/side as BCPM | mg/$m^2$/side blue dye A |
|---|---|---|---|---|---|
| 1(comp.) | 0.183 | — | — | — | — |
| 2(inv.) | 0.147 | AgX-layer | BCPM | 120 | 9.6 |
| 3(inv.) | 0.147 | AgX-layer | BCPM | 73 | 5.8 |
| 4(comp.) | 0.147 | Antistress | BCPM | 73 | 5.8 |
| 5(comp.) | 0.147 | AgX-layer | MBDD | — | 10.5 |
| 6(comp.) | 0.147 | Antistress | MBDD | — | 10.5 |

In Table II the following data are summarized:

fog (FOG);

photographic sensitivity S (log E(xposure): a lower figure is indicative for a higher speed as less radiation is required to get a density of 1.00 above fog);

image tone: the more positive the figures, given after visual examination in transmission of the processed films, the better the image-tone (more "cold-blue" looking);

screen stain: the X-ray screen (format 24 cm×30 cm) was made slightly wet with Agfa-Gevaert Curix "screen-cleaner", mainly consisting of isopropanol. On the wetted X-ray screen, samples of the undeveloped photographic materials were placed. Thereupon a cardboard and a weight of 10 kg was placed during 2 hours, whereafter the samples were removed and the color of the X-ray screen was examined for dye stain on the screen ("screen stain"). The X-ray screen used in this dye stain test was CURIX ORTHO REGULAR 1FFJ5P (trademarketed screen by Agfa-Gevaert NV).

From Table II hereinafter it can be concluded that addition of the dispersion of polymeric matting agents loaded with dye A to the light-sensitive emulsion layer of the radiographic film as in the inventive examples results in a more neutral (cold-black, fresh-looking) image tone of the developed silver without loss of the photographic speed or increase of the fog level after processing and without leaving screen stain (present if the blue dye is present as a milled dispersion, not in polymeric matting form) after contact of the said film with intensifying screens after exposure.

TABLE II

| MATL No. | Dye present in | FOG | S | Image Tone | Screen stain |
|---|---|---|---|---|---|
| 1(comp.) | — | 0.214 | 1.48 | 0 | NO |
| 2(inv.) | Agx-layer | 0.200 | 1.46 | +3 | NO |
| 3(inv.) | Agx-layer | 0.190 | 1.42 | +1 | NO |
| 4(comp.) | Antistress | 0.191 | 1.42 | −1 | NO |
| 5(comp.) | Agx-layer | 0.200 | 1.47 | 0 | YES |
| 6(comp.) | Antistress | 0.200 | 1.47 | 0 | YES |

What is claimed is:

1. Image-forming method for medical diagnostic imaging comprising:

providing a photosensitive silver halide film material comprising a support and on one or both sides thereof one or more layers(s) comprising a photosensitive silver halide emulsion wherein tabular silver halide crystals having an average thickness of less than 0.25 μm and an average aspect ratio of 2 or more are present wherein said photosensitive silver halide emulsion layer(s) comprise(s) homodisperse polymeric matting particles free from conglomerates and loaded with blue dye; and providing said photosensitive silver halide film material in operative association with one or two intensifying screens to process said film material to form an image by image-wise exposure to visible light, generated from converted x-rays, said one or two intensifying screens including a support for said one or two screens wherein said support includes a layer of a light emitting luminescent phosphor.

2. Method according to claim 1, wherein said tabular silver halide crystals have an aspect ratio of from 2 to 20, a thickness of from 0.06 μm to less than 0.25 μm and account for at least 50% of the total projective area of all grains.

3. Method according to claim 1, wherein said blue colored polymer matting particles are blue colored polymeric methylmethacrylate particles.

4. Method according to claim 1, wherein said blue colored polymeric matting particles comprise a pigment or dye selected from the group consisting of phthalocyanine dyes or indanthron dyes.

5. Method according to claim 1, wherein said blue colored polymeric matting particles have a maximum absorption in the visible wavelength region from 570 to 700 nm.

6. Method according to claim 1, wherein said blue colored polymeric matting particles have a maximum absorption in the visible wavelength region from 570 to 630 nm.

7. Method according to claim 1, wherein said blue colored polymeric matting particles are present in said emulsion layer(s) in an amount corresponding with an amount of blue dye from 10 $mg/m^2$ to 1000 $mg/m^2$.

8. Method according to claim 1, wherein said blue colored polymeric matting particles have an average particle size of from 1 μm up to 10 μm.

9. Method according to claim 1, wherein said silver halide is silver chloride, silver chlorobromide, silver chloroiodide, silver chlorobromoiodide, silver bromide, silver bromochloride, silver bromochloroiodide or silver bromoiodide.

* * * * *